US006832928B2

(12) United States Patent
Suzuki

(10) Patent No.: US 6,832,928 B2
(45) Date of Patent: Dec. 21, 2004

(54) CONNECTOR ASSEMBLY AND CONNECTOR USED IN THE SAME

(75) Inventor: Mitsuru Suzuki, Kanagawa (JP)

(73) Assignee: Tyco Electronics AMP K.K., Kawasaki (JP)

( * ) Notice: Subject to any disclaimer, the term of this patent is extended or adjusted under 35 U.S.C. 154(b) by 0 days.

(21) Appl. No.: 10/646,085

(22) Filed: Aug. 22, 2003

(65) Prior Publication Data

US 2004/0067677 A1 Apr. 8, 2004

(30) Foreign Application Priority Data

Aug. 30, 2002 (JP) ..... 2002-255062

(51) Int. Cl.[7] ..... H01R 13/627
(52) U.S. Cl. ..... 439/357; 439/358
(58) Field of Search ..... 439/357, 358, 439/364

(56) References Cited

U.S. PATENT DOCUMENTS 5,827,086 A * 10/1998 Fukuda ..... 439/357
6,254,417 B1 * 7/2001 Pan ..... 439/357
6,609,833 B1 * 8/2003 Miyachi et al. ..... 439/357

FOREIGN PATENT DOCUMENTS

| | | |
|---|---|---|
| JP | 56-5385 | 1/1981 |
| JP | 1981-5385 | 1/1981 |
| JP | 2000-77138 | 3/2000 |
| JP | 2000077138 A | 3/2000 |

* cited by examiner

*Primary Examiner*—Tho D. Ta
(74) *Attorney, Agent, or Firm*—Barley Snyder

(57) ABSTRACT

The present invention provides a connector assembly with a low height in which the latching arm is protected, and connectors used in this connector assembly. The connector assembly I comprises a first connector A and a second connector B which are mated with each other. The first connector A has a plurality of contact passageways 11 and 12 defined by tubular walls that are arranged in a single row, a latching arm 17 which is disposed so that this latching arm is connected to the tubular walls defining two adjacent contact passageways 11 and 12, and top walls 13 and 15 that connect the tubular walls defining the two adjacent contact passageways 11 and 12 such that the latching arm 17 is covered. The second connector B has mating apertures 31 and 32 that receive the tubular walls defining the contact passageways 11 and 12, and a catch 36 that is latch-engaged with the latching arm 17.

13 Claims, 10 Drawing Sheets

CONNECTOR ASSEMBLY AND CONNECTOR USED IN THE SAME

FIELD OF THE INVENTION

The present invention relates to a connector assembly used to connect electrical wires to each other, or to connect circuit boards and electrical wires, etc., and a connector used in the same.

BACKGROUND

Connectors are used in a wide variety of applications to connect one set of wires to a second set of wires, or to connect a set of wires to a circuit board, or the like. An existing connector 100 is described in Japanese Utility Model Application Kokai No. S56-5385, and shown in FIG. 9 (A). The connector 100 has an insulating housing 110. The housing 110 has four contact passageways 111 in a lower row, and two contact passageways 111 in an upper row. Furthermore, a connecting plate part 113 which connects a pair of housing walls 112 that define the two contact passageways 111 of the upper row is disposed on the facing surfaces of these two housing walls 112, and a cantilevered latching arm 114 extends rearward (toward the left in FIG. 9 (A)) from the central portion of the connecting plate part 113. A latching projection 115 is protrudes from the fixed end portion of the latching arm 114 that is fastened to the connecting plate part 113 so that this latching projection 115 straddles the upper surfaces of the latching arm 114 and connecting plate part 113. An operating part 116 for releasing the latching arm 114 protrudes from the rear end portion of the latching arm 114 that is located on the opposite end of the latching arm 114 from the fixed end portion (i.e., the free end of the cantilevered latching arm). The upper surface of the latching arm 114 and the upper surface of the connecting plate part 113 are coplanar with the upper surfaces of the housing walls 112. Electrical contacts (not shown in the figures), that are connected to electrical wires, are accommodated inside the contact passageways 111 of the housing 110.

The connector 100 is configured to mate with a mating connector not shown in the figures. When the connector 100 mates with the mating connector, electrical contacts connected to electrical wires disposed in the mating connector and the electrical contacts of the connector 100 contact each other, such that the two sets of electrical wires are electrically connected to each other. When the two connectors are mated, the latching projection 115 formed on the latching arm 114 of the connector 100 is latched in a latching part (not shown in the figures) formed in the mating connector, such that both connectors are mated and fastened together. Then, to release the mating of the two connectors, the operating part 116 disposed on the latching arm 114 of the connector 100 is pressed downward, causing the latching arm 114 to be elastically deformed downward such that the latching of the latching projection 115 is released.

Another existing connector 200, shown in FIG. 9 (B), has a construction that is basically similar to that of the connector 100 shown in FIG. 9 (A). However, the manner of attachment of the connecting plate part 213, latching arm 214 and latching projection 215 to the housing walls 212 differs from the manner of attachment of the connecting plate part 113, latching arm 114 and latching projection 115 to the housing walls 112 in connector 100.

Specifically, a connecting plate part 213 which connects a pair of housing walls 212 that define the two contact accommodating compartments 211 of the upper row is disposed on substantially the intermediate portions (with respect to the vertical direction) of the two housing walls 212. Also, a latching projection 215 protrudes in an upright position from the central portion (in the lengthwise direction) of the upper surface of the connecting plate part 213. A cantilevered latching arm 214 extends rearward (toward the left in FIG. 9 (B)) from this latching projection 215. An operating part 216 for operating the latching arm 214 is formed so that it protrudes from the rear end portion of the latching arm 214 located on the opposite end of the latching arm 214 from the fixed end portion that is fastened to the latching projection 215 (i.e., from the free end of the cantilevered latching arm). Moreover, only the upper surface of the latching arm 214 is coplanar with the upper surfaces of the housing walls 212.

Yet another existing connector 300, shown in FIG. 10 (and described in Japanese Patent Application Kokai No. 2000-77138) can be used to electrically connect electrical wires to each other. The connector 300 comprises an insulating housing 310. The housing 310 has a plurality of contact passageways 311 in two rows (upper and lower). A pivoting latching arm 312 is disposed above the contact passageways 311 on the housing 310, and a latching projection 313 is formed on the rear tip end (toward the left in FIG. 10) of the latching arm 312. Moreover, a protective wall 314, which covers and protects the latching arm 312 from above, is disposed on the housing 310. Electrical contacts (not shown in the figure) are accommodated inside the contact passageways 311 of the housing 310 and connected to a set of electrical wires.

This connector 300 mates with a mating connector 400. Mating connector 400 has electrical contacts 411 that are connected to a second set of electrical wires and disposed in the mating connector 400. When the connector 300 mates with the mating connector 400 the electrical contacts of the connector 300 and the mating connector 400 contact each other, such that the two sets of electrical wires are electrically connected to each other. When the two connectors 300 and 400 are mated, the latching projection 313 formed on the latching arm 312 of the connector 300 is latched on a latching projecting part 412 formed on the mating housing 410, so that the two connectors 300 and 400 are mated and fastened together.

Since the upper surfaces of the latching arms 114 and 214 of connectors 100 and 200 are coplanar with the upper surfaces of the housing walls 112 and 212, a low connector height is achieved, However, since these latching arms 114 and 214 have an exposed construction, the latching arms 114 and 214 cannot be protected.

In the case of the connector 300 shown in FIG. 10, on the other hand, since a protective wall 314 that covers and protects the latching arm 312 from above is disposed on the housing 310, the latching arm 312 can be protected. However, since the latching arm 312 is disposed above the contact passageways 311, a low connector height cannot be achieved.

SUMMARY

According to an exemplary embodiment of the present invention, a connector and connector assembly are provided that have a protected latching arm and low profile or height. This exemplary connector assembly comprises a first connector and a second connector that are mated with each other. The first connector has a plurality of contact passageways that are disposed in a single row, a latching arm which is disposed between two adjacent contact passageways and pivotally connected to the tubular walls defining these contact passageways, and a top wall which also connects tubular walls defining the two contact passageways so that this top wall covers the latching arm. The second connector has mating apertures that receive the tubular walls defining the contact passageways, and a catch, such as a projection, shoulder, or the like, that is latch-engaged with the latching arm.

In one exemplary embodiment of the present invention the latching arm of the first connector has an optional rib that extends in the direction of mating, and the catch of the second connector has a groove that guides the rib.

BRIEF DESCRIPTION OF THE DRAWINGS

The invention will now be described by way of example with reference to the accompanying figures of which:

FIG. 9 (B) is a perspective view of another existing connector; and

DETAILED DESCRIPTION

Figure 1:
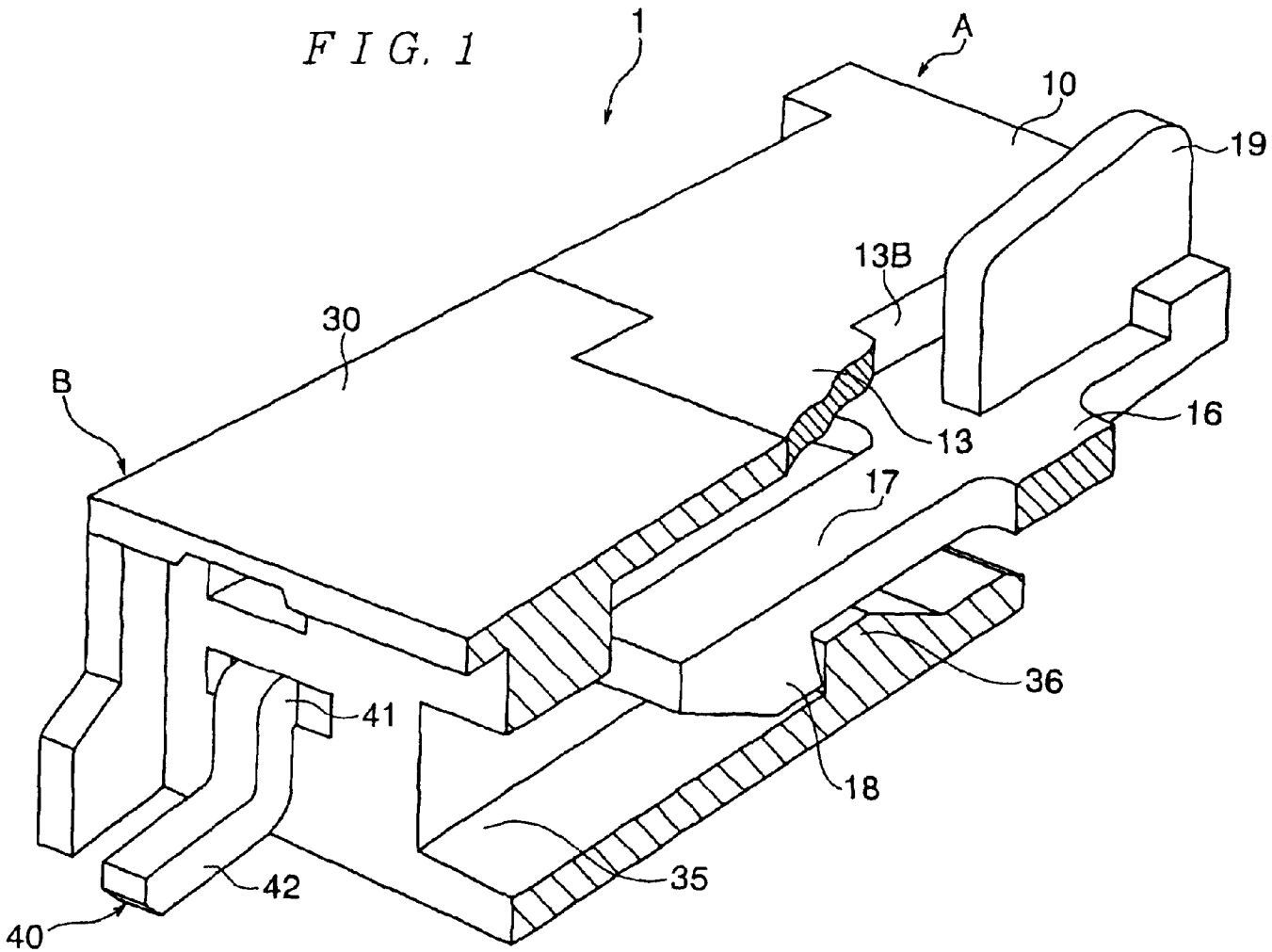
FIG. 1 is a perspective view showing a longitudinal section of an exemplary connector assembly according to an embodiment of the present invention.

Next, an exemplary embodiment of the present invention will be described with reference to the figures. FIG. 1 through FIG. 6 (B) show an exemplary connector assembly and connector according to an embodiment of the present invention. As is shown in FIG. 1, the connector assembly 1 is constructed from a first connector A and a second connector B that are mated with each other.

As is shown in FIGS. 1 through 4, the first connector A is constructed from an insulating first housing 10, having a plurality of conductive first contacts (not shown in the figures) which are accommodated in contact passageways 11 and 12 in the housing 10. Electrical wires are connected to the first contacts.

The first housing 10 may be formed, for example, by molding an insulating synthetic resin such as a PBT, and has a plurality of contact passageways 11 and 12 (two contact passageways in the illustrated embodiment) defined by tubular walls and arranged in a single row. Each contact passageway 11 and 12 is constructed such that it extends forward (toward the front or viewer in FIG. 2 (A)) from a substantially box-shaped base part 11A or 12A. Rear openings 11C and 12C which open toward the rear of contact passages 11 and 12 are formed at the rear of the first housing 10. The first contacts are accommodated inside the respective rear openings 11C and 12C. Front openings 11B and 12B are configured to receive the mating contacts (the second contacts of the second connector B described later) and are formed at the front ends of the respective contact passageways 11C and 12C. The lower edges of the facing surfaces of the base parts 11A and 12A of the contact passageways 11 and 12 are connected by a bottom wall 14.

Figure 3:
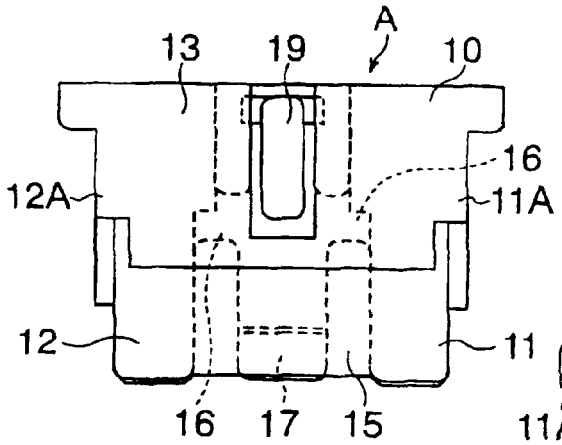
FIGS. 3 (A) through 3 (E) show the first connector of FIGS. 2 (A) and 2 (B), with FIG. 3 (A) being a plan view, FIG. 3 (B) being a front view, FIG. 3 (C) being a back view, FIG. 3 (D) being a bottom view, and FIG. 3 (E) being a right-side view.
Figure 3:
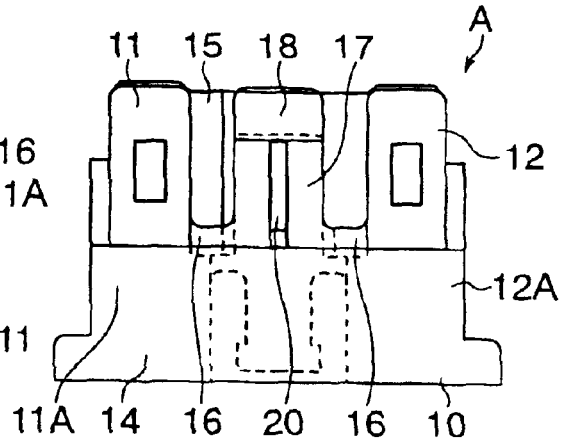
Figure 3:
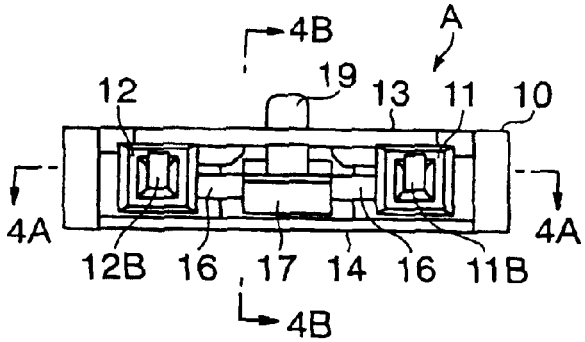
Figure 3:
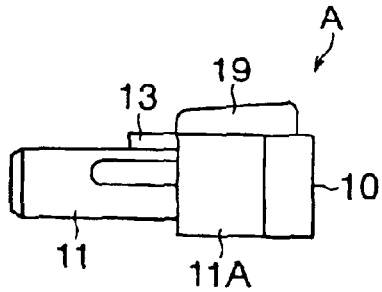
Figure 3:
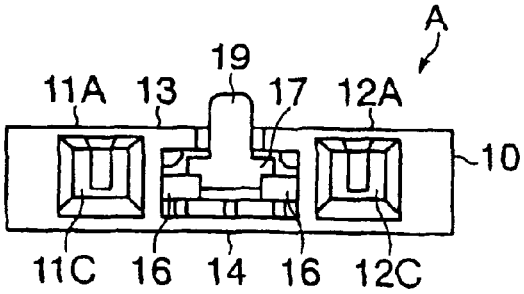
Figure 4:
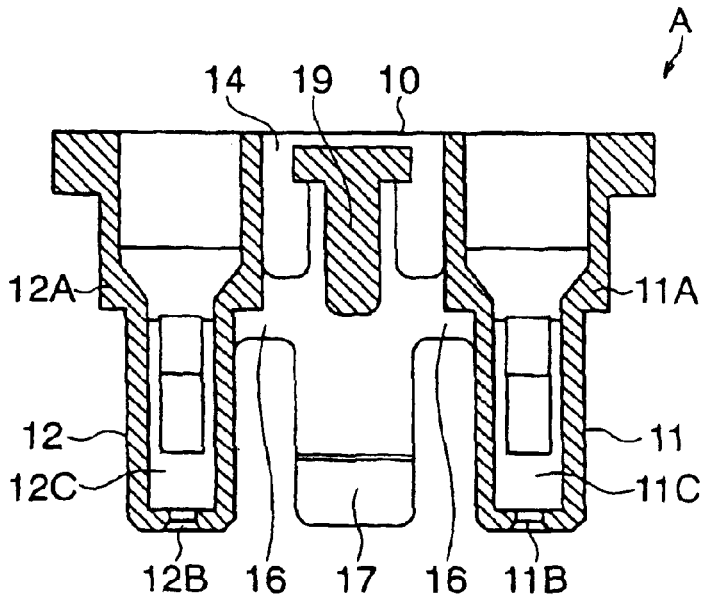
FIGS. 4 (A) and 4 (B) show the first connector of FIG. 3 (B), with FIG. 4 (A) being a sectional view along line 4A—4A in FIG. 3 (B), and FIG. 4 (B) being a sectional view along line 4B—4B in FIG. 3 (B)
Figure 4:
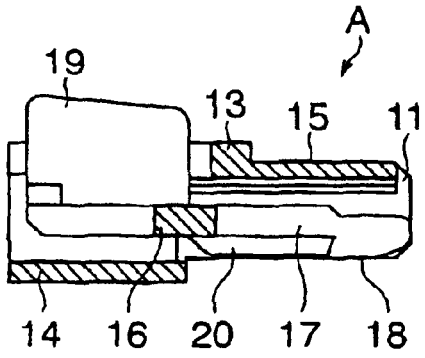

A latching arm 17, which latch-engages with a catch 36 on the mating connector B when the first connector A is mated with the second connector B, is disposed between the two adjacent contact passageways 11 and 12. The latching arm 17 is connected to the walls defining the two contact passageways 11 and 12 via a connecting web 16 at substantially the central portion of the walls defining the contact passageways 11 and 12 in the forward-rearward direction (i.e., along the mating axis). The upper surface of the latching arm 17 does not protrude further upward than the upper surfaces of the walls defining the contact passageways 11 and 12. Also, the latching arm 17 is pivotally connected to the contact-accomodating tubular parts by the connecting web 16, such that it can swing upward and downward about the connecting web 16. Because the connecting web 16 has a smaller cross-section than the walls defining the contact passageways 11 and 12 and the latching 17, it forms a native hinge, about which the latching arm 17 can rotate. The front end surface of the latching arm 17 is substantially coplanar with the front end surfaces of the walls defining the contact passageways 11 and 12, and the rear end surface of the latching arm 17 is substantially coplanar with the rear end surfaces of the base parts 11A and 12A. Moreover, a latching projection 18, which protrudes downward, is formed on the front end of the latching arm 17, and an release projection 19 which protrudes upward is formed on the rear end of the latching arm. As is shown in FIGS. 3 (D) and 4 (B), an optional rib 20, which extends rearward from the latching projection 18 in the direction of mating, is formed on the undersurface of the latching arm 17. The rigidity of the latching arm 17 can be increased by means of this rib 20.

Figure 2B:
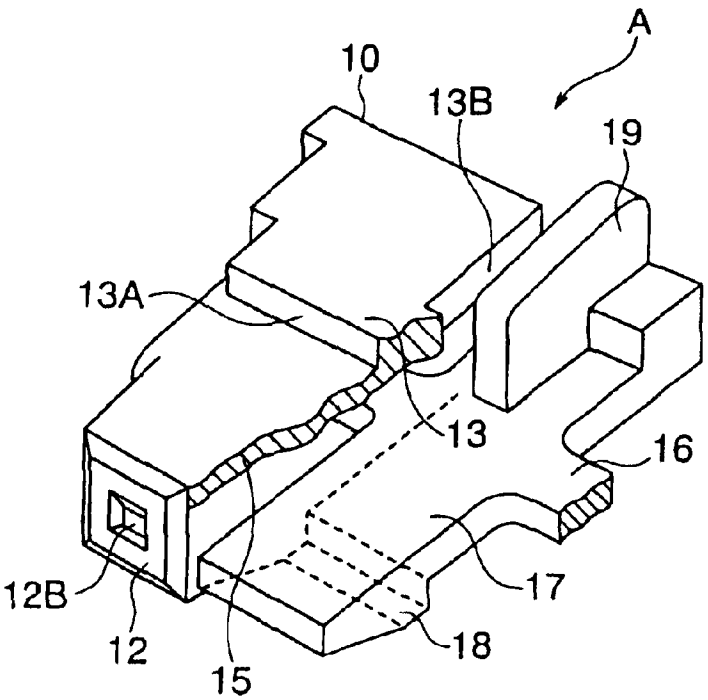
FIGS. 2 (A) and 2 (B) show the first connector of FIG. 1, with FIG. 2 (A) being a perspective view, and FIG. 2 (B) being a perspective view that shows a longitudinal section.
Figure 2A:
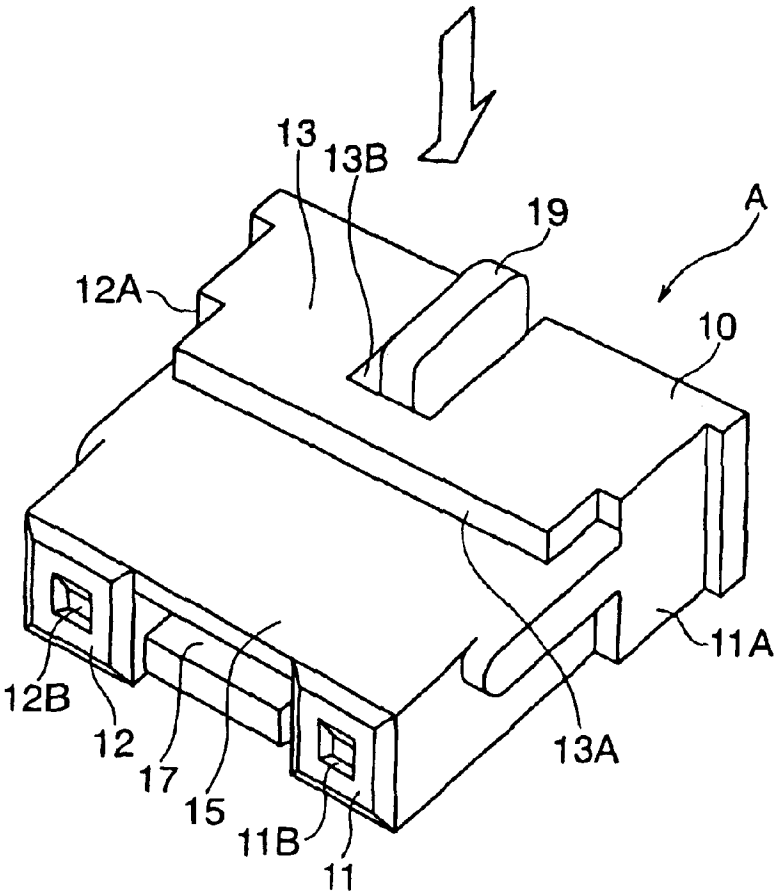

The walls defining the contact passageways 11 and 12 (including the base parts 11A and 12A) are interconnected by a first top wall 13 at the upper edges of the facing surfaces of the tubular walls defining the contact passageways 11 and 12, toward the rear of the first connector A. The upper edges of the facing surfaces of the respective walls defining the contact passageways 11 and 12 located further toward the front than the first top wall 13 are connected by a second top wall 15. As is shown in FIG. 2, the first top wall 13 and second top wall 15 are connected via a step surface 13A, and have a structure which is such that the top of the latching arm 17 is covered by the first top wall 13 and second top wall 15.

The first top wall 13 and second top wall 15 protect the latching arm from damage. A cut-out 13B is formed in the first top wall 13, which makes it possible for the release projection 19 that protrudes from the latching arm 17 to protrude further than the upper surface of the first top wall 13. This allows the release projection 19 to be accessible when the connectors A and B are mated.

Figure 5A:
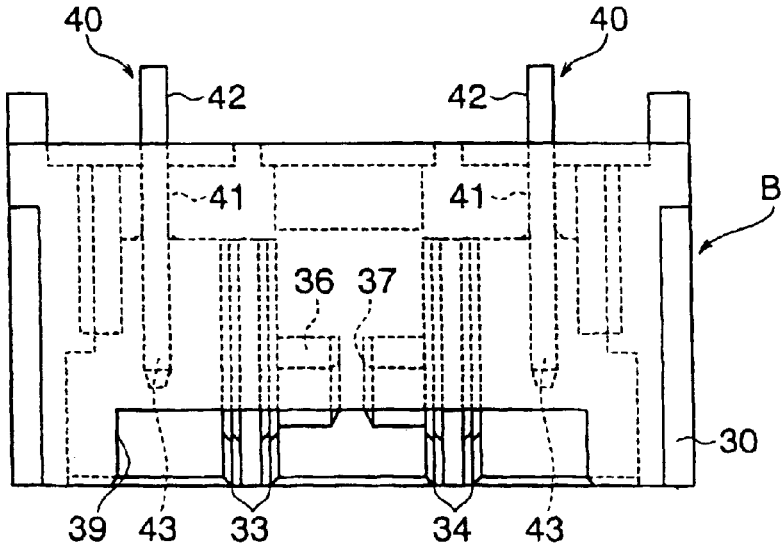
FIGS. 5 (A) through 5 (C) show the second connector of FIG. 1, with FIG. 5 (A) being a plan view, FIG. 5 (B) being a front view, and FIG. 5 (C) being a left-side view.
Figure 5B:
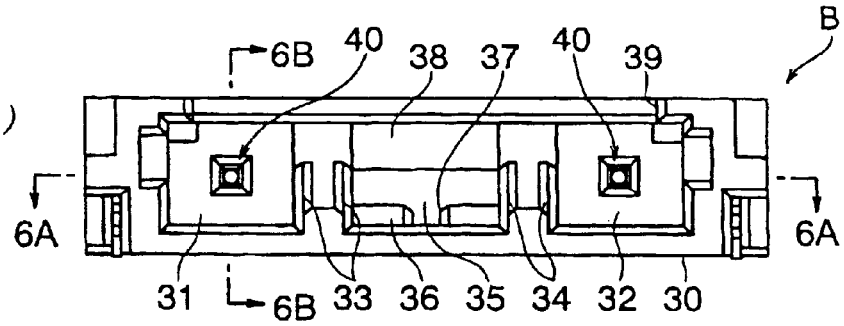
Figure 5C:
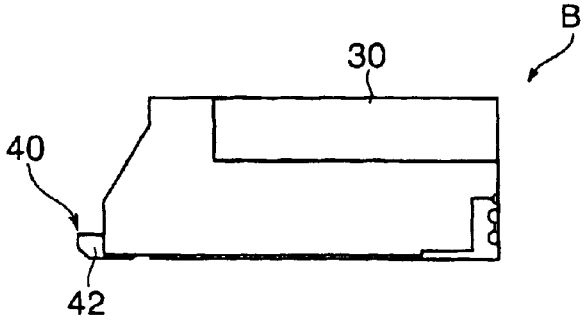
Figure 6:
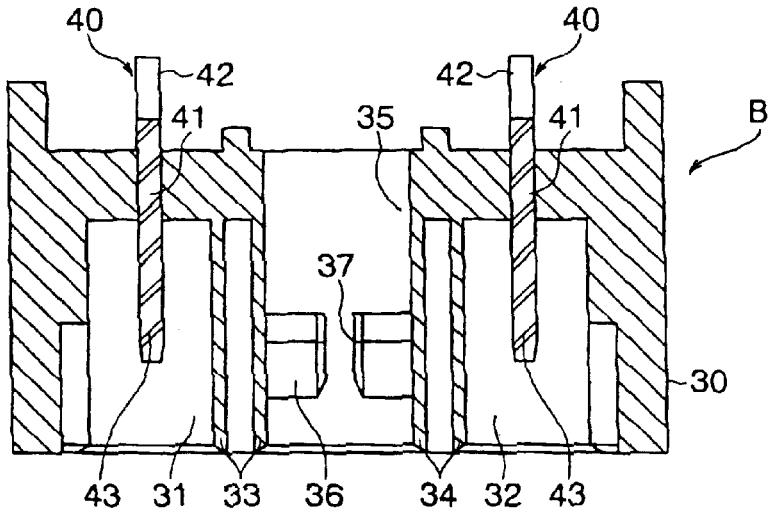
FIGS. 6 (A) and 6 (B) show the second connector of FIG. 5 (B), with FIG. 6 (A) being a sectional view along line 6A—6A in FIG. 5 (B), and FIG. 6 (B) being a sectional view along line 6B—6B in FIG. 5 (B)
Figure 6:
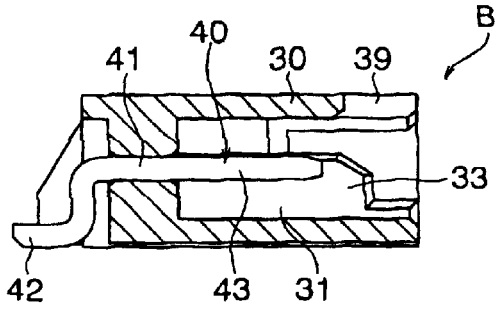

As is shown in FIGS. 1, 5 and 6, the second connector B is constructed from an insulating second housing 30, and a plurality of conductive second contacts 40 which are attached to the housing 30.

The second housing 30 may be formed, for example, by molding an insulating synthetic resin such as a PBT. The second housing has mating apertures 31 and 32 that receive the tubular walls defining the contact passageways 11 and 12 of the first connector A when the two connectors A and B are mated. The mating apertures 31 and 32 open at the front surface (the lower surface in FIG. 5 (A)) of the second housing 30. Furthermore, a latching arm receiving opening 35 that receives the latching arm 17 of the first connector A when the two connectors A and B are mated is formed between the mating apertures 31 and 32. Partition walls 33 protrude from the bottom wall of the second housing 30 between one mating aperture 31 and the latching arm receiving opening 35, and partition walls 34 protrude from the bottom wall of the second housing 30 between the other mating aperture 32 and the latching arm receiving opening 35. An opening 38 which receives the second top wall 15 of the first connector A when the two connectors A and B are mated is formed above the respective partition walls 33 and 34. A cut-out 39 which receives a portion of the first top wall 13 of the first connector A on the front end side of the second connector B when the two connectors A and B are mated is formed in the front end of the top wall of the second housing 30.

Furthermore, a catch 36, with which the latching projection 18 formed on the latching arm 17 is latch-engaged when the two connectors A and B are mated, protrudes from the bottom wall of the second housing 30 in the latching arm receiving opening 35. A groove 37 may be formed in the catch to guide the optional rib 20 formed on the latching arm 17 when the connectors A and B are mated. The groove 37 extends rearward in the direction of mating from the front surface of the catch 36 to the rear surface.

The respective second contacts 40 may be formed in the shape of posts by stamping and forming conductive plates, for example. The second contacts 40 have fastening parts 41 that are press-fitted to the rear walls of the housing 30 at the rear of the mating apertures 31 and 32. Each of the second contacts 40 may also comprise a solder foot 42 (in the case in which the connector assembly connects the wires to a circuit board). The solder foot extends rearward from the fastening part 41 and is connected by soldering to the circuit board (not shown in the figures). A contact blade 43 extends forward from the fastening part 41 and protrudes into the mating aperture 31 or 32. The contact blades 43 enter the front opening 11B and 12B of cantact passageways 11 and 12 and contact the first contacts of the first connector A when the two connectors A and B are mated.

Next, the operation of mating the first connector A and second connector B will be described.

The first contacts, which are connected to electrical wires, are accommodated inside the respective contact passageways 11 and 12 of the first connector A to complete the first connector A. The solder feet 42 of the second contacts 40 of the second connector B are connected by soldering to the surface of the circuit board.

Then, the first connector A and second connector B are mated, such that the contact passageways 11 and 12 of the first connector A are received inside the mating apertures 31 and 32 of the second connector B and the contact blades 43 of the second contacts 40 enter the front opening 11B and 12B of the contact passageways 11 and 12 making electrical contact with first contacts. Also, during mating, the second top wall 15 of the first connector A is received inside the opening 38 of the second connector B, and a portion of the front end of the first top wall 13 is received in the cut-out 39. Also, when the connectors A and B are mated, the latching arm 17 of the first connector A is received inside the latching arm receiving opening 35 of the second connector B. When the latching arm 17 is received, the latching arm 17 moves upward while the latching projection 18 formed on the front end of the latching arm 17 moves over the catch 36 of the second connector B. As the mating of the connectors A and B is further advanced, the latching arm 17 moves downward, and so that the latching projection 18 is positioned on the rear side of the catch 36 and latch-engaged as shown in FIG. 1. As a result of this latching engagement, the mating and fastening of both connectors A and B is accomplished. When the latching projection 18 of the latching arm 17 is latch-engaged with the catch 36, the optional rib 20 formed on the latching arm 17 is guided by the groove 37 formed in the catch 36. The engagement of the optional rib 20 in the groove 37 reduces "kojiri" or "rocking" in the direction of alignment of the contact passageways in the first connector A. Consequently twisting and flexing of the latching arm 17 can be reduced.

When the two connectors A and B are mated, the first contacts of the first connector A and the contact blades 43 of the second contacts 40 of the second connector B make contact, such that the electrical wires and the circuit board are electrically connected to each other. To release the mating of two connectors A and B, the release projection 19 formed on the rear end of the latching arm 17 is pressed from above as indicated by the arrow in FIG. 2 (A), pivoting the latching arm 17 and causing that latching projection 18 on the front end of the latching arm 17 to move upward, thus releasing the latching engagement of the latching projection 18 with the catch 36.

The first connector A, according to an exemplary embodiment of the invention, is provided with the latching arm 17 such that this latching arm 17 connects the facing walls defining two adjacent contact passageways 11 and 12. The first top wall 13 and second top wall 15, which also connect the walls defining the two contact passageways 11 and 12, cover the latching arm 17. Accordingly, the connector can be formed with a low height, and the latching arm 17 can be securely protected.

The second connector B has mating apertures 31 and 32 that receive the tubular walls defining the contact passageways 11 and 12 of the first connector A, and a catch 36 that latch-engages with the latching arm 17. Accordingly, by using this connector together with the first connector A, it is possible to obtain a connector assembly with a low height in which the latching arm 17 can be protected.

An embodiment of the present invention was described above. However, the present invention is not limited to this embodiment; various alterations and modifications are possible.

For example, the first contacts of the first connector A are connected to electrical wires, and the second contacts 40 of the second connector B are connected to a circuit board, so that the electrical wires and circuit board are connected to each other. However, it would also be possible to connect two sets of electrical wires to each other, or to connect circuit boards to each other.

Also, in the embodiment described above, an release projection 19 protrudes upward from the rear end of the latching arm 17 of the first connector A, the upper end of this release projection 19 protrudes upward from the cut-out 13B, and the latching engagement is released by pressing the upper end of this release projection 19 in the direction indicated by the arrow in FIG. 2 (A). However, it would also be possible to alter this system as shown in FIGS. 7 (A) and (B) or as shown in 8 (A) and (B).

Figure 7B:
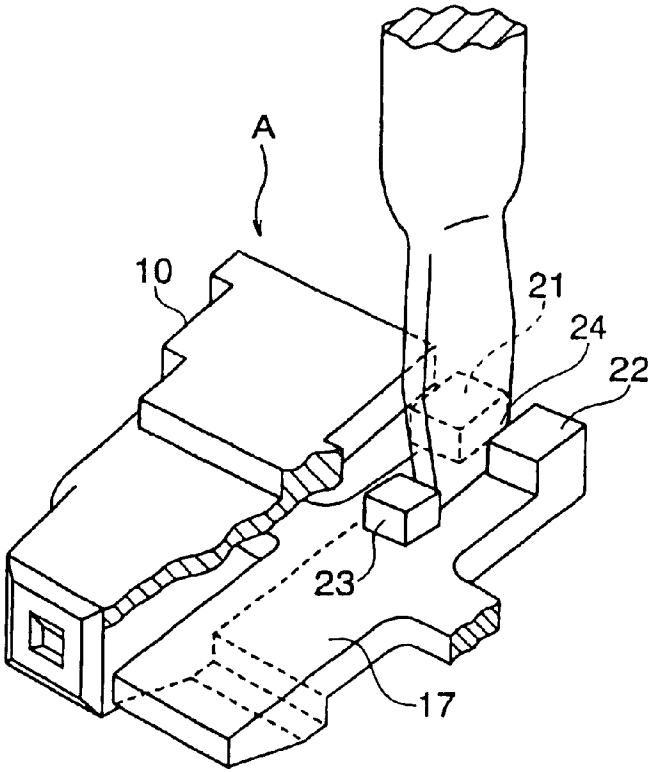
FIGS. 7 (A) and 7 (B) show-s an alternative exemplary first connector together with a tool, with FIG. 7 (A) being a perspective view showing a state prior to the insertion of the tip end of the tool into the accommodating part of the first connector, and FIG. 7 (B) being a perspective view showing a state in which the tip end of the tool has been caused to contact the latching arm in the accommodating part (shown in a longitudinal section)
Figure 7A:
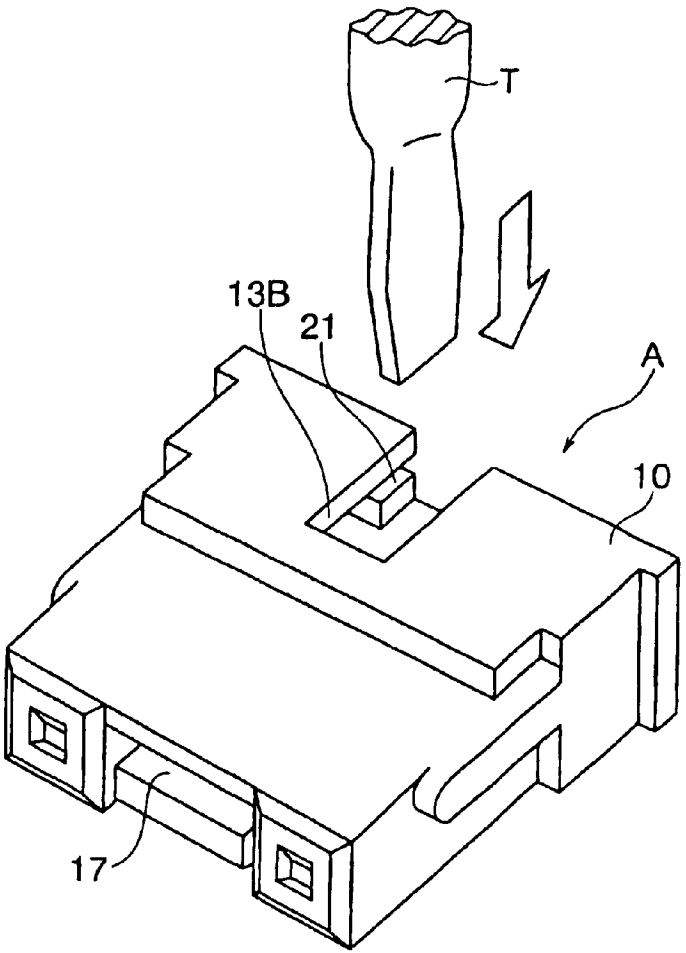

As shown in FIGS. 7 (A) and 7 (B), a pair of projections 21 and 22 are disposed on the upper surface of the rear end of the latching arm 17 of the first connector A with a gap that allows the entry of the tip end of a tool T formed between these projections. Also, a projection 23 which prevents the movement of the tip end of the tool T in the forward direction is disposed on the upper surface of the latching arm 17 further toward the front than the projections 21 and 22. Thus, an accommodating part 24 for the tip end of the tool T is demarcated on the upper surface of the rear end of the latching arm 17. The latching engagement is released by inserting the tip end of the tool T in the direction indicated by the arrow in FIG. 7 (A) into the cut-out 13B, and pressing the upper surface of the rear end of the latching arm 17 in the accommodating part 24. In this embodiment, there is no need to cause the release projection 19 to protrude beyond the upper surface of the first top wall 13 of the first connector A as shown in FIG. 2, so that a lower connector height can be obtained.

Figure 8B:
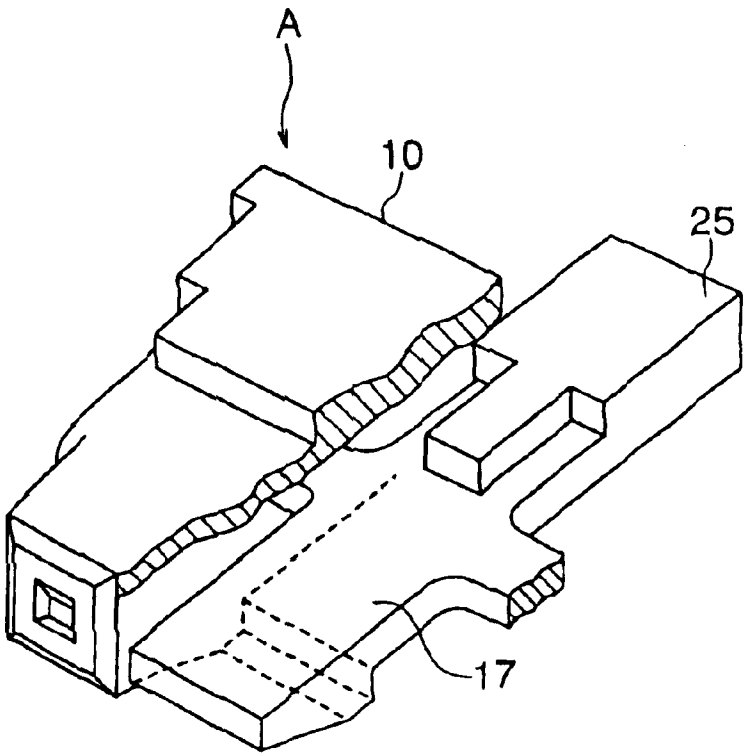
FIGS. 8 (A) and 8 (B) show another alternative embodiment of the first connector, with FIG. 8 (A) being a perspective view, and FIG. 8 (B) being a perspective view showing a longitudinal section.
Figure 8A:
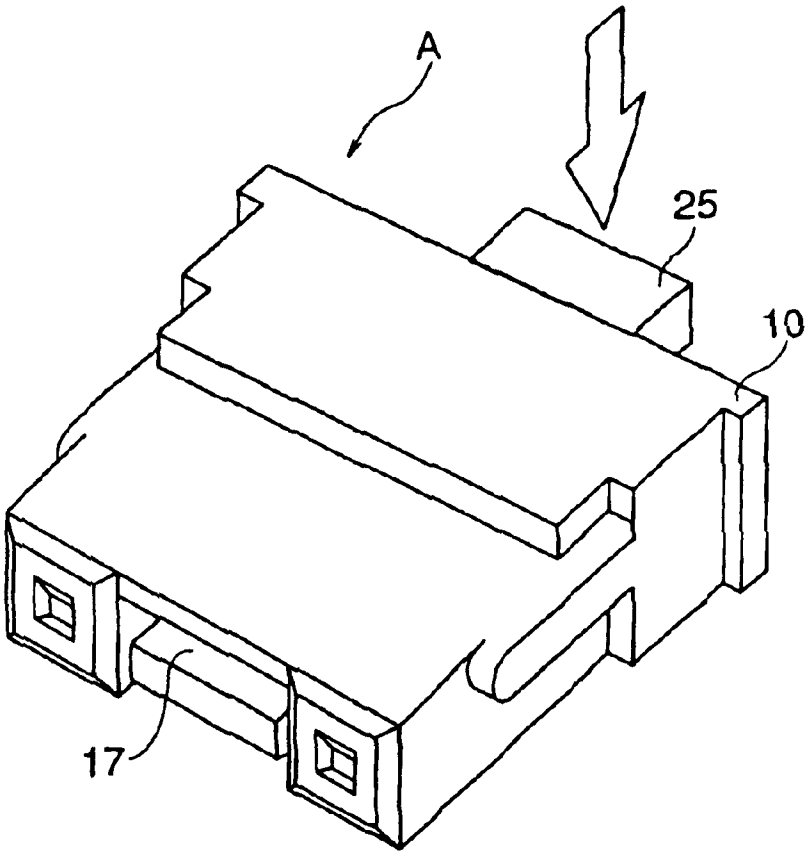
Figure 9:
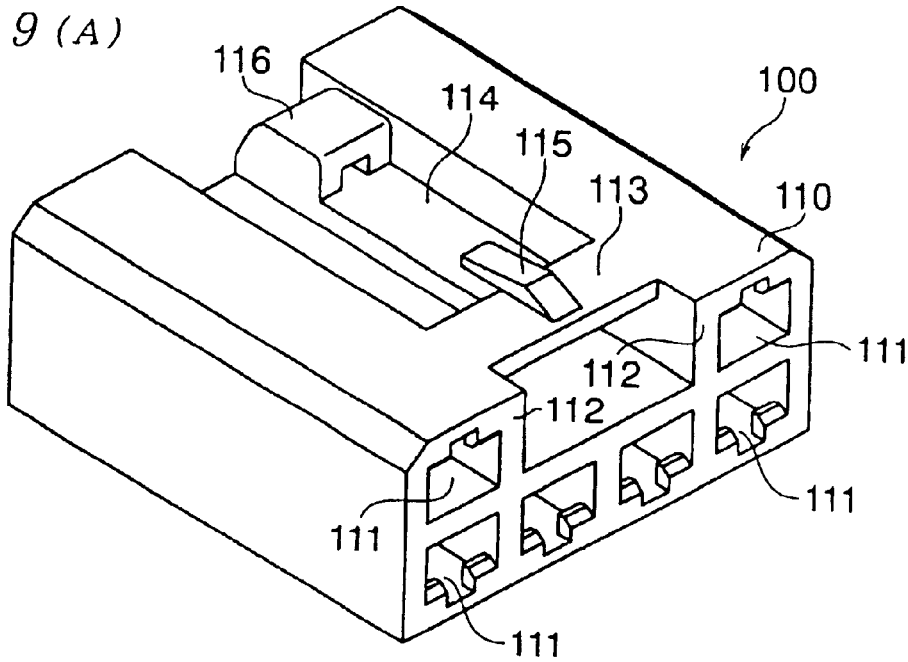
FIG. 9 (A) is a perspective view of an existing connector.
Figure 9:
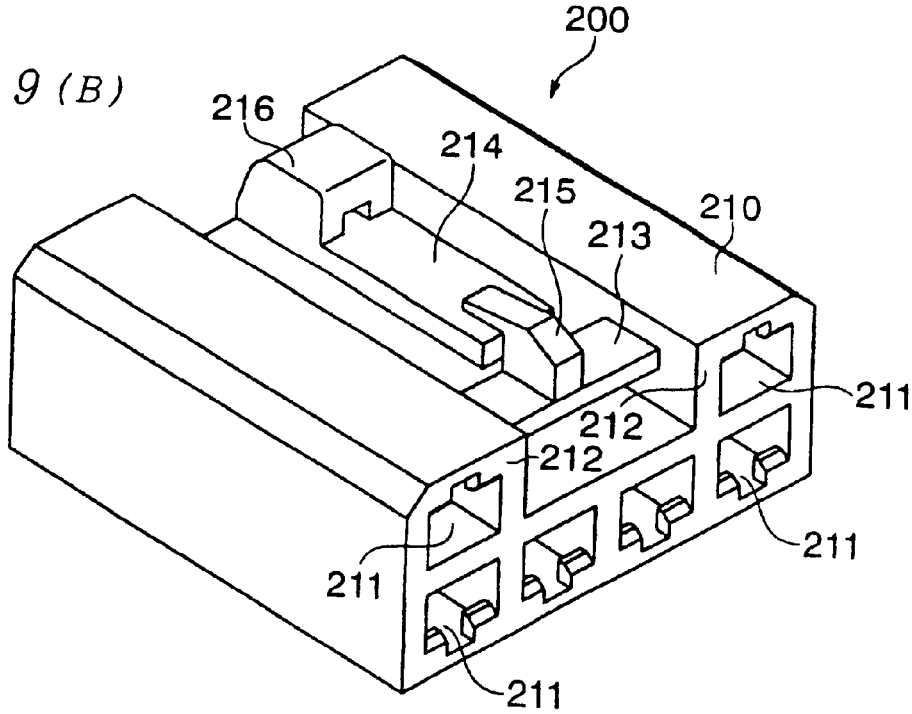
Figure 10:
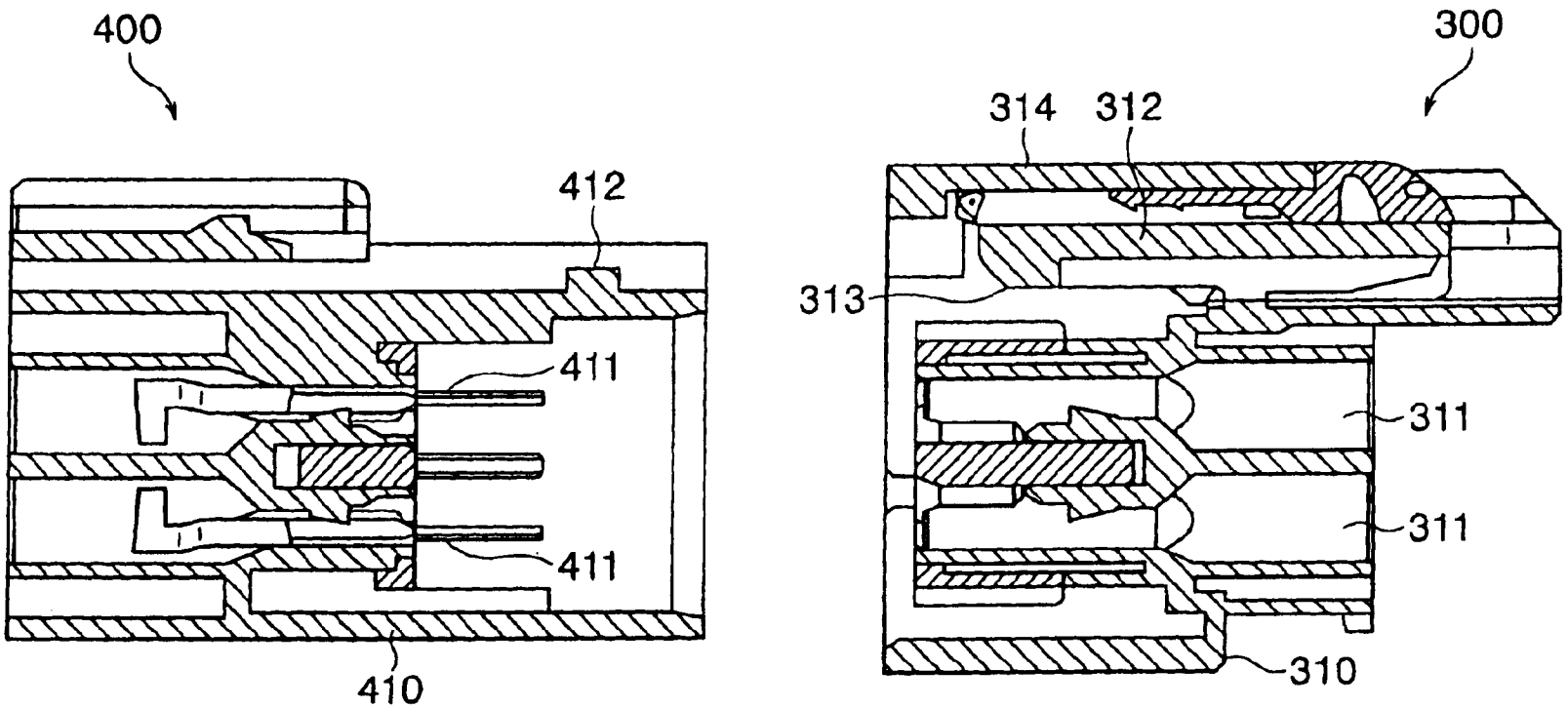
FIG. 10 is a sectional view which shows another existing connector along with a mating connector.

In the embodiment shown in FIGS. 8 (A) and 8 (B), an extension part 25 is provided which extends the rear end of the latching arm 17 of the first connector A further to the rear than the rear end surface of the first housing 10. In this embodiment, the latching engagement is released by pressing the upper surface of this extension part 25 in the direction indicated by the arrow in FIG. 8 (A). Again, in this embodiment, there is no need to have an release projection 19 that protrudes beyond the upper surface of the first wall 13 of the first connector A, and a lower connector height can be obtained.

What is claimed is:

1. A connector assembly comprising a first connector and a second connector that are mated with each other, the first connector having a plurality of contact passageways that are disposed in a single row, a latching arm disposed between two adjacent contact passageways and pivotally connected to tubular walls defining the contact passageways, and a top wall connecting the two contact passageways and covering the latching arm, and the second connector having mating apertures that receive the tubular walls defining the contact passageways, and a catch that latch-engages with the latching arm.

2. The connector assembly according to claim 1, wherein the latching arm of the first connector has a rib that extends in the direction of mating, and the catch of the second connector has a groove that guides the rib.

3. The connector assembly according to claim 1 wherein a release projection protrudes upward from the rear end of the latching arm to pivot the latching arm and release the mating connection of the connectors.

4. The connector assembly according to claim 1 wherein a latching arm art extends to the rear of the top wall.

5. The connector assembly according to claim 1 wherein an accommodating part for a tip end of a tool is provided on the rear end of the latching arm and a cut-out is provided in the top wall to allow the tool to engage the accommodating part to release the mating of the connectors.

6. The connector assembly according to claim 1 wherein the latching arm is pivotally connected to the contact accommodating tubular walls by a connecting web.

7. The connector assembly according to claim 6 wherein the connecting web is disposed at substantially the central portion of the tubular walls defining the contact passageways along the mating axis.

8. A connector which has a plurality of contact passageways that are disposed in a single row and defined by tubular walls, a latching arm which is disposed between and pivotally connected to the walls defining two adjacent contact passageways by a connecting web, and a top wall which connects the tubular walls that define the two adjacent contact passageways such that the top wall covers the latching arm.

9. The connector according to claim 8 wherein the connecting web is disposed at substantially the central portion of the walls defining the two adjacent contact passageways along the mating axis.

10. The connector according to claim 8, further comprising a rib extending along the latching arm.

11. The connector according to claim 10 wherein a release projection protrudes upward from the rear end of the latching arm.

12. The connector assembly according to claim 10 wherein a latching arm extension part extends to the rear of the top wall.

13. The connector assembly according to claim 10 wherein an accommodating part for a tip end of a tool is provided on the rear end of the latching arm and a cut-out is provided in the wall to allow the tool to engage the accommodating part.

* * * * *

UNITED STATES PATENT AND TRADEMARK OFFICE

CERTIFICATE OF CORRECTION

PATENT NO. : 6,832,928 B2
DATED : December 21, 2004
INVENTOR(S) : Mitsuru Suzuki It is certified that error appears in the above-identified patent and that said Letters Patent is hereby corrected as shown below:

Column 8,
Line 14, "a latching arm art extends" should read -- a latching arm extension part extends --

Signed and Sealed this

Twelfth Day of July, 2005

JON W. DUDAS
*Director of the United States Patent and Trademark Office*